US011566789B1

(12) United States Patent
Singh et al.

(10) Patent No.: US 11,566,789 B1
(45) Date of Patent: Jan. 31, 2023

(54) FERRULE FOR FUEL-AIR MIXER ASSEMBLY

(71) Applicant: General Electric Company, Schenectady, NY (US)

(72) Inventors: Saket Singh, Bengaluru (IN); Pradeep Naik, Bengaluru (IN); Rimple Rangrej, Bengaluru (IN); Ranganatha Narasimha Chiranthan, Bengaluru (IN); Veeraraju Vanapalli, Bengaluru (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/655,453

(22) Filed: Mar. 18, 2022

(30) Foreign Application Priority Data

Nov. 22, 2021 (IN) ..... 202111053608

(51) Int. Cl.
*F23R 3/28* (2006.01)
*F23R 3/14* (2006.01)

(52) U.S. Cl.
CPC ..... *F23R 3/14* (2013.01); *F23R 3/286* (2013.01)

(58) Field of Classification Search
CPC ..... F23R 3/12; F23R 3/14; F23R 3/28; F23R 3/283; F23R 3/286; F23R 2900/03041; F23R 2900/03042
See application file for complete search history.

(56) References Cited

U.S. PATENT DOCUMENTS 4,198,815 A * 4/1980 Bobo ..... F23R 3/14 60/737
5,321,951 A * 6/1994 Falls ..... F23R 3/34 60/740
5,941,075 A * 8/1999 Ansart ..... F23R 3/14 60/737
6,546,732 B1 * 4/2003 Young ..... F23D 14/78 60/740
7,546,739 B2 6/2009 Holland et al.
(Continued)

FOREIGN PATENT DOCUMENTS

FR 2974162 A1 10/2012
FR 3080168 A1 10/2019
FR 3081211 A1 11/2019

*Primary Examiner* — William H Rodriguez
(74) *Attorney, Agent, or Firm* — Venable LLP; Michele V. Frank

(57) ABSTRACT

A ferrule in a fuel-air mixer assembly. The ferrule includes a body having (i) a plurality of channels having sidewalls, the plurality of channels leading to a corresponding plurality of exit openings, the plurality of channels configured to guide a first airflow therein and (ii) a plurality of cascade holes formed within the sidewalls of the plurality of channels and defining a plurality of passageways therein that are transverse to the plurality of channels. The ferrule also includes a plurality of airflow modifiers provided within the plurality of channels. The plurality airflow modifiers are configured to reduce a velocity of the first airflow when the first airflow exits through the plurality of exit openings and to generate low velocity vortex pairs to reduce interaction of the first airflow with a second airflow provided through primary vanes located downstream of the plurality of exit openings of the plurality of channels.

20 Claims, 7 Drawing Sheets

(56) References Cited

U.S. PATENT DOCUMENTS

| | | | | |
|---|---|---|---|---|
| 8,205,452 | B2 | 6/2012 | Boardman et al. | |
| 9,228,747 | B2 | 1/2016 | Prociw et al. | |
| 9,366,187 | B2 | 6/2016 | Patel et al. | |
| 2004/0143967 | A1* | 7/2004 | Caldwell | B23P 6/005 29/889.1 |
| 2006/0059915 | A1* | 3/2006 | Furletov | F23R 3/30 60/740 |
| 2018/0058696 | A1 | 3/2018 | Danis et al. | |
| 2020/0248903 | A1* | 8/2020 | Sampath | F23R 3/14 |

* cited by examiner

FERRULE FOR FUEL-AIR MIXER ASSEMBLY

CROSS REFERENCE TO RELATED APPLICATIONS

The present application claims the benefit of Indian Patent Application No. 202111053608, filed on Nov. 22, 2021, which is hereby incorporated by reference herein in its entirety.

TECHNICAL FIELD

The present disclosure relates generally to fuel-air mixer assemblies and, in particular, to a ferrule for a fuel-air mixer assembly.

BACKGROUND

Engines, and, particularly, gas turbine engines, are rotary engines that extract energy from a flow of combusted gases passing through the engine onto a multitude of turbine blades. Turbine engines have been used for land and nautical locomotion, and power generation. Turbine engines are commonly used for aeronautical applications such as for aircraft, including helicopters and airplanes. In aircraft, turbine engines are used for propulsion of the aircraft. In terrestrial applications, turbine engines are often used for power generation.

Turbine engines include fuel-air mixer assemblies for mixing fuel and air in a combustion chamber of the turbine engines. In rich burn combustion systems, swirler induced instabilities can originate instabilities in fuel and heat distribution inside combustor causing high combustion hydrodynamics (P'4). Interaction of ferrule hole flow with primary vane air streams at high velocity causes higher perturbation in the flow before the fuel nozzle. For efficient operation of the fuel-air mixing system, low P'4 is desired.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Additional features, advantages, and embodiments of the present disclosure are set forth or apparent from consideration of the following detailed description, drawings, and claims. Moreover, it is to be understood that both the foregoing summary of the present disclosure and the following detailed description are exemplary and intended to provide further explanation without limiting the scope of the disclosure as claimed.

Various embodiments of the present disclosure are discussed in detail below. While specific embodiments are discussed, this is done for illustration purposes only. A person skilled in the relevant art will recognize that other components and configurations may be used without departing from the spirit and scope of the present disclosure.

In the following specification and the claims, reference may be made to a number "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

As used herein, the terms "axial" and "axially" refer to directions and orientations that extend substantially parallel to a centerline of the turbine engine or the combustor. Moreover, the terms "radial" and "radially" refer to directions and orientations that extend substantially perpendicular to the centerline of the turbine engine or the fuel-air mixer assembly. In addition, as used herein, the terms "circumferential" and "circumferentially" refer to directions and orientations that extend arcuately about the centerline of the turbine engine or the fuel-air mixer assembly.

Embodiments of the present disclosure seek to create low energy vortex pairs to reduce flow instabilities in the flow before fuel nozzle tip. A cascade of holes on ferrule plate with ribs can be employed to create low velocity vortex pairs as the air flow emerges out from ferrule exit holes. Low velocity vortex pairs do not create strong interaction of ferrule flow with primary vane flow leading to lower level of flow instabilities within venturi, as will be described further a detail in the following paragraphs.

Figure 1:
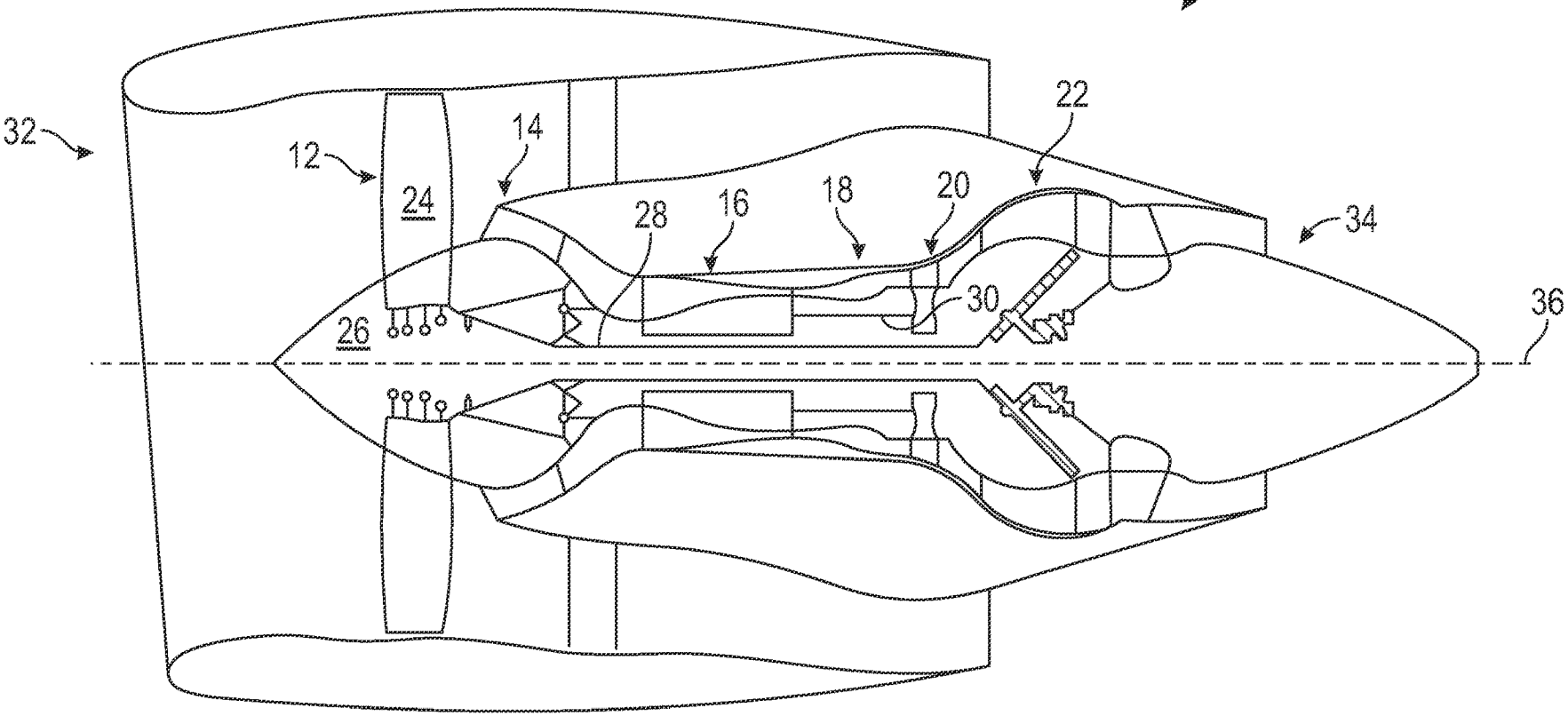
FIG. 1 is a schematic diagram of a turbine engine, according to an embodiment of the present disclosure.

FIG. 1 is a schematic diagram of a turbine engine 10, according to an embodiment of the present disclosure. The turbine engine 10 includes a fan assembly 12, a low-pressure or booster compressor assembly 14, a high-pressure compressor assembly 16, and a combustor assembly 18. Fan assembly 12, booster compressor assembly 14, high-pressure compressor assembly 16, and combustor assembly 18 are coupled in flow communication. Turbine engine 10 also includes a high-pressure turbine assembly 20 coupled in flow communication with combustor assembly 18 and a low-pressure turbine assembly 22. Fan assembly 12 includes an array of fan blades 24 extending radially outward from a rotor disk 26. Low-pressure turbine assembly 22 is coupled to fan assembly 12 and booster compressor assembly 14 through a first drive shaft 28, and high-pressure turbine assembly 20 is coupled to high-pressure compressor assembly 16 through a second drive shaft 30. Turbine engine 10 has an intake 32 and an exhaust 34. Turbine engine 10 further includes a centerline (axis) 36 about which fan assembly 12, booster compressor assembly 14, high-pressure compressor assembly 16, high-pressure turbine assembly 20 and low-pressure turbine assembly 22 rotate.

In operation, air entering turbine engine 10 through intake 32 is channeled through fan assembly 12 towards booster compressor assembly 14. Compressed air is discharged from booster compressor assembly 14 towards high-pressure compressor assembly 16. Highly compressed air is channeled from high-pressure compressor assembly 16 towards combustor assembly 18, mixed with fuel, and the mixture is combusted within combustor assembly 18. High temperature combustion gas generated by combustor assembly 18 is channeled towards turbine assemblies 20 and 22. Combustion gas is subsequently discharged from turbine engine 10 via exhaust 34.

Figure 2:
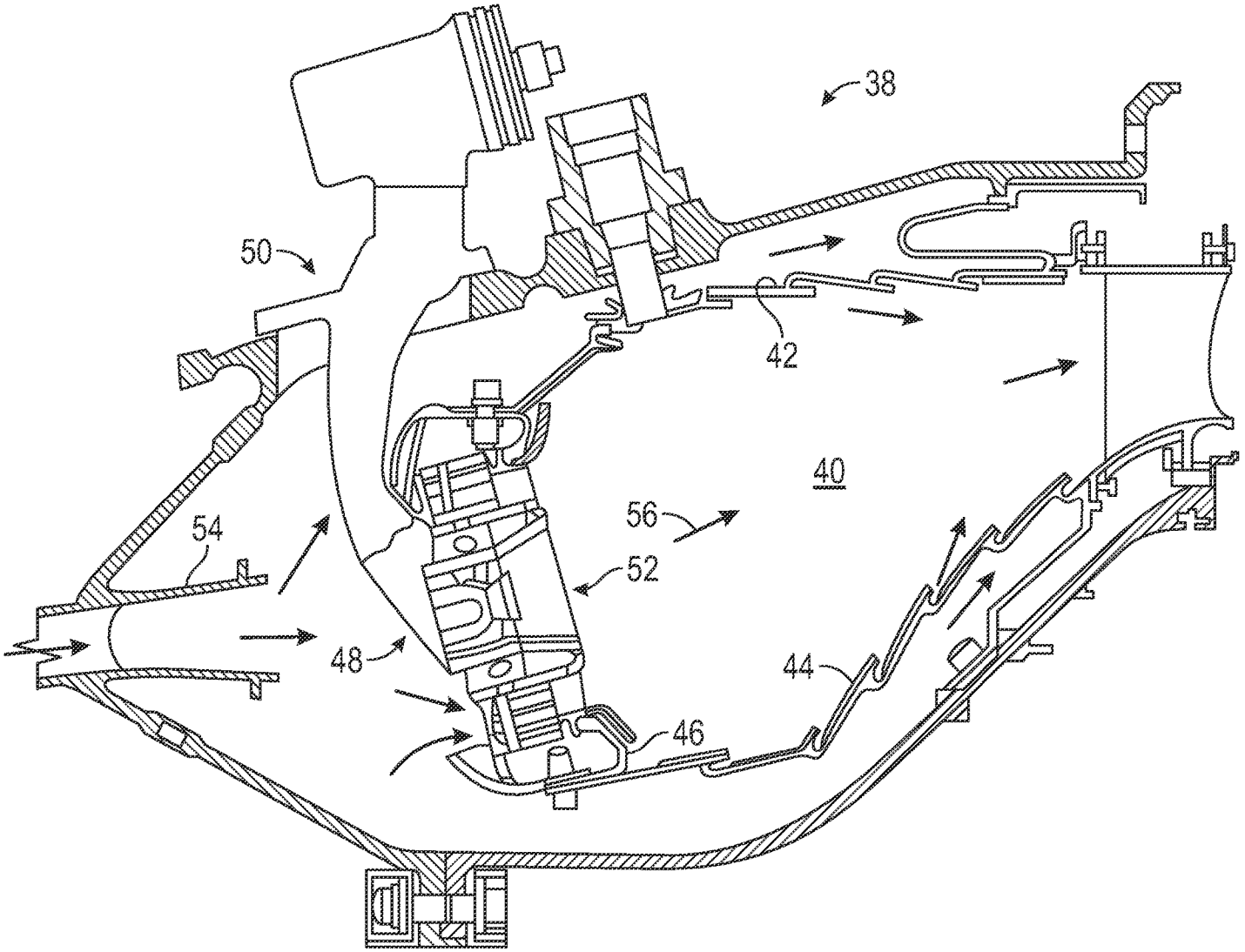
FIG. 2 is a cross-sectional view of a portion of a combustor of a combustor assembly of the turbine engine, according to an embodiment of the present disclosure.

FIG. 2 is a cross-sectional view of a portion of a combustor 38 of combustor assembly 18 of the turbine engine 10, according to an embodiment of the present disclosure. The combustor 38 defines a combustion chamber 40 in which the highly compressed air is mixed with fuel and combusted. Combustor 38 includes an outer liner 42 and an inner liner 44. Outer liner 42 defines an outer boundary of the combustion chamber 40, and inner liner 44 defines an inner boundary of combustion chamber 40. An annular dome 46 is mounted upstream from outer liner 42 and inner liner 44 and defines an upstream end of combustion chamber 40. One or more fuel injection systems 48 are positioned on annular dome 46. In an embodiment, each fuel injection system 48 includes a fuel nozzle assembly 50 and a fuel-air mixer assembly 52 coupled to fuel nozzle assembly 50. Fuel-air mixer assembly 52 receives fuel from fuel nozzle assembly 50, receives air from high-pressure compressor assembly 16 (shown in FIG. 1) via a diffuser 54, and discharges a fuel-air mixture 56 into combustion chamber 40 where the mixture is ignited and burned.

Figure 3:
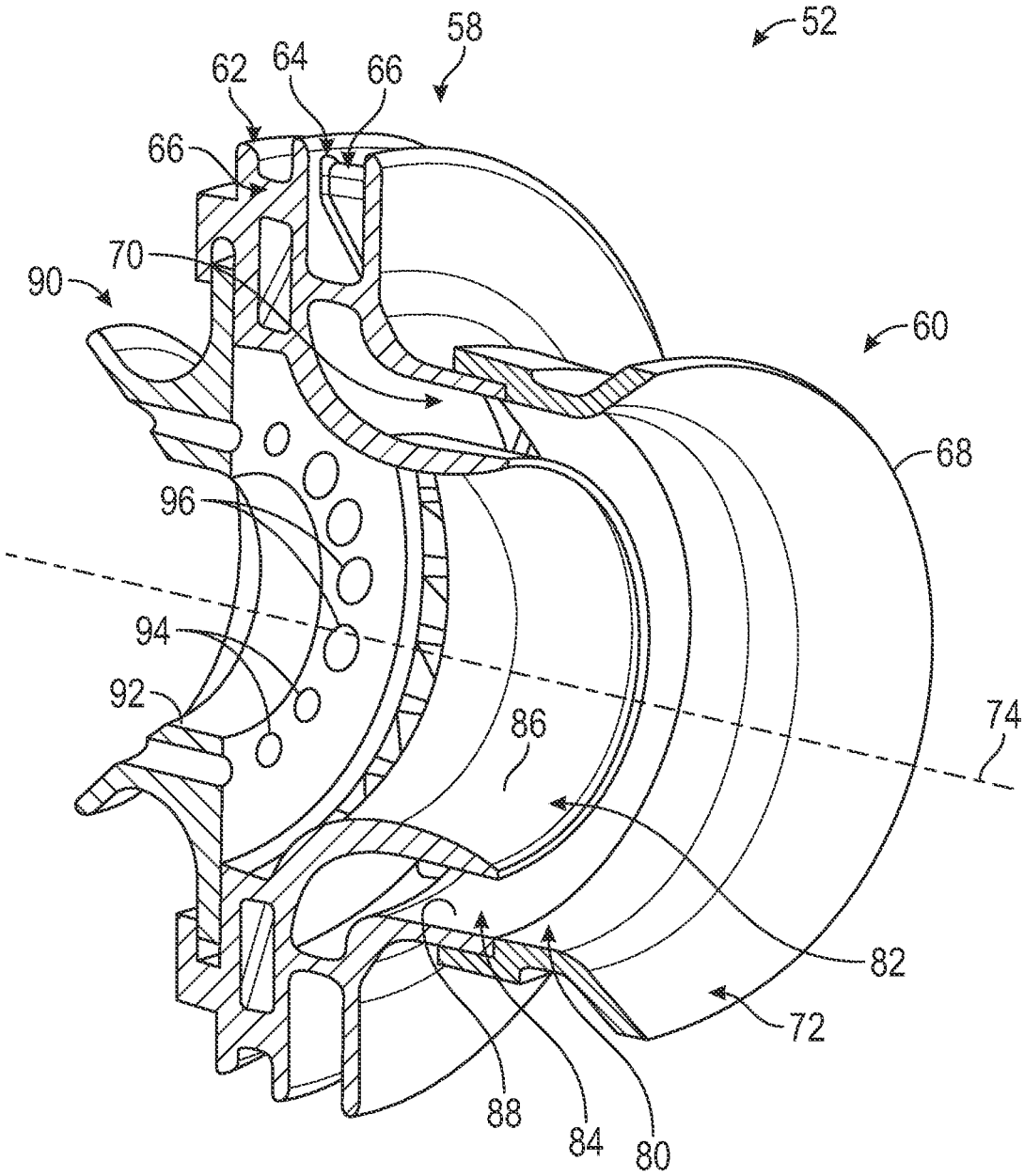
FIG. 3 is a cross-sectional view of fuel-air mixer assembly that may be used in the combustor (shown in FIG. 2), according to an embodiment of the present disclosure.

FIG. 3 is a cross-sectional view of fuel-air mixer assembly 52 that may be used in combustor 38 (shown in FIG. 2), according to an embodiment of the present disclosure. In an embodiment, fuel-air mixer assembly 52 includes a mixer portion 58 and a flare cup portion 60 coupled to the mixer portion 58. In an embodiment, the mixer portion 58 includes a first radial flow passage 62 and a second radial flow passage 64 each having a swirler vane assembly (primary vanes) 66 positioned therein. Flare cup portion 60 includes a side wall 68 that has an inlet opening 70 and a discharge opening 72 defined therein. Flow in the flare cup is mixed with secondary swirler flow. Side wall 68 is oriented such that discharge opening 72 is axi-asymmetrically shaped relative to a centerline 74 of fuel-air mixer assembly 52. The fuel-air mixture 56 (shown in FIG. 2) is discharged from fuel-air mixer assembly 52 during operation of combustor 38. More specifically, fuel-air mixture 56 generally swirls circumferentially about centerline 74 before being discharged from fuel-air mixer assembly 52. As such, shaping discharge opening 72 axi-asymmetrically relative to centerline 74 facilitates disrupting a symmetrical flow field of fuel-air mixture 56 before being discharged from fuel-air mixer assembly 52.

In the exemplary embodiment, mixer portion 58 includes a discharge end 80 in communication with flare cup portion 60 at inlet opening 70. In operation, fuel and air are mixed within mixer portion 58 and discharged from mixer portion 58 through an outlet 82 defined at discharge end 80. In addition, air enters mixer portion 58 radially and is discharged from mixer portion 58 through an annular opening 84 defined at discharge end 80. Outlet 82 is defined by a first side wall 86 and annular opening 84 is defined by a second side wall 88. In an embodiment, first side wall 86 and second side wall 88 are both shaped axi-symmetrically relative to centerline 74. Similarly, side wall 68 of flare cup portion 60 at inlet opening 70 is shaped axi-symmetrically relative to centerline 74. As such, flare cup portion 60 is retrofittable onto an existing cylindrical discharge end 80 of mixer portion 58.

Fuel-air mixer assembly 52 also includes a ferrule 90 coupled to mixer portion 58. Ferrule 90 includes a fuel nozzle 92 and a plurality of purge holes 94, 96 defined therein. The plurality of purge holes 94, 96 direct axial airflow into mixer portion 58. In addition, the plurality of purge holes 94, 96 include first purge holes 94 and second purge holes 96 defined in the ferrule 90 and arranged circumferentially relative to centerline 74. In an embodiment, first purge holes 94 can be sized to be smaller than second purge holes 96. The first purge holes 94 and the second purge holes 96 are arranged axi-asymmetrically based on the size of first purge holes 94 and second purge holes 96 relative to centerline 74. However, the purge holes 94, 96 can also have the same size.

In a rich burn combustion system, swirler induced instabilities in fuel-air mixture can generate instabilities in fuel and heat distribution inside the combustion chamber 40 (shown in FIG. 2) causing high combustion hydrodynamics (P'4). In an embodiment, interaction of ferrule hole flow with primary vane air streams at high velocity causes higher perturbation in the airflow before fuel nozzle 92. For efficient operation of the system, low P'4 is desired. Accordingly, an embodiment of the present disclosure seeks to create low energy vortex pairs to reduce flow instabilities in the flow before fuel nozzle 92.

Figure 4:
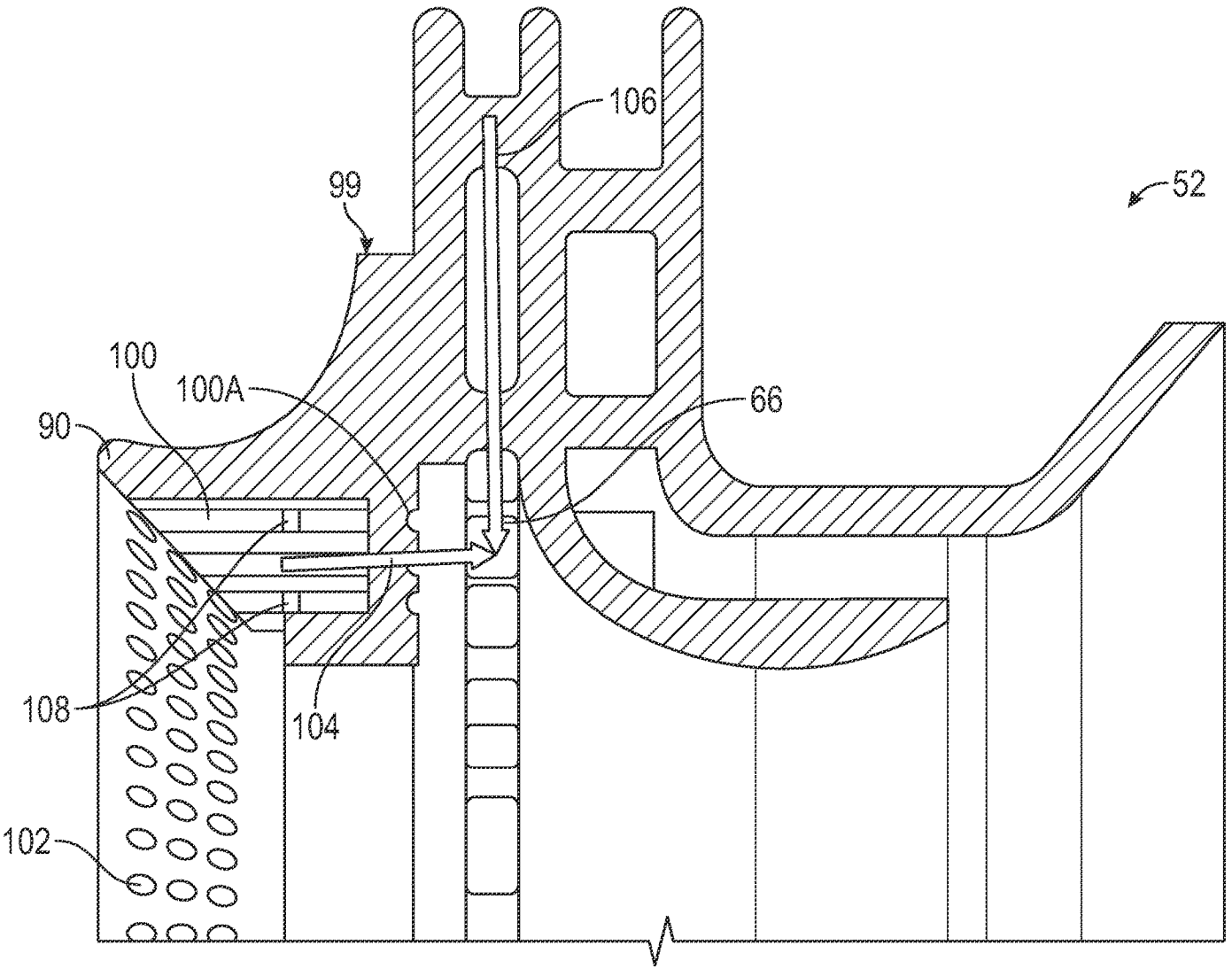
FIG. 4 is an enlarged cross-sectional side view of the fuel-air mixer assembly showing a ferrule, according to an embodiment of the present disclosure.

FIG. 4 is an enlarged cross-sectional side view of the fuel-air mixer assembly 52 showing the ferrule 90, according to an embodiment of the present disclosure. The ferrule 90 includes a body 99 having a plurality of channels 100 connected to a plurality of holes 102. The plurality of channels 100 include a plurality of exit openings 100A. Airflow 104 penetrates through the plurality of holes 102 to be guided through the corresponding plurality of channels 100 and to exit through the plurality of exit openings 100A. The airflow 104 in each channel 100 mixes with incoming primary vane airflow 106 in the orthogonal direction from primary vanes 66 to create an airflow perturbation. The primary vanes 66 are located downstream of the ferrule 90. In an embodiment the primary vanes 66 are located downstream the plurality of channels 100 and specifically downstream of the plurality of exit openings 100A. The interaction of the airflow 104 from the plurality of channels 100 with the orthogonal primary vane airflow 106 can create swirler instabilities which can ultimately generate instabilities and turbulence in fuel-air mixture and heat distribution during combustion of the fuel-air mixture. In order to remedy this deficiency, a plurality of cascade holes 108 are provided in the ferrule 90 within each of the plurality of channels 100. Each of the plurality of cascade holes 108 is provided within sidewalls 100W (shown in FIG. 5) of each of the plurality of channels 100. As shown in FIG. 4, the cascade holes 108 define passageways 109 (shown in FIG. 5) that are transverse to the plurality of the channels 100. A plurality of airflow modifiers such as a plurality of pins 110 (shown in FIG. 7) can be inserted through the holes 108. In an embodiment, each of the plurality of passageways 109 is substantially perpendicular to at least one of the plurality of channels 100. In another embodiment, each of the plurality of passageways 109 is arranged at an angle (e.g., an angle different from ninety degrees) relative to a direction of at least one of the plurality of channels 100. In another embodiment, the plurality of passageways 109 can be configured so that one passageway 109 is provided in each channel 100 instead of multiple passageways 109 in each channel 100.

Figure 5:
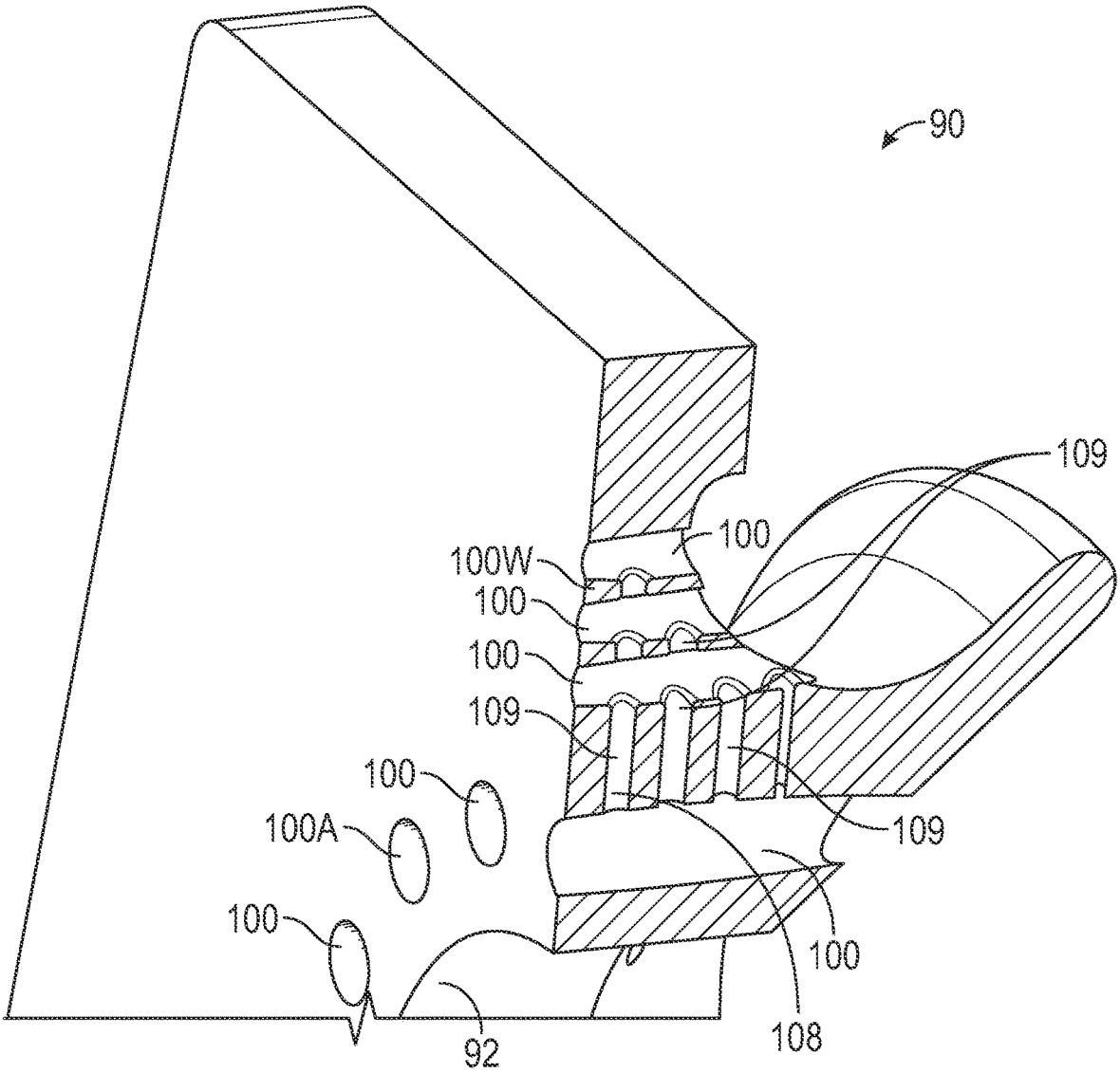
FIG. 5 is a cut-through view of the ferrule (shown in FIG. 4), according to an embodiment of the present disclosure.

FIG. 5 is a cut-through view of the ferrule 90, according to an embodiment of the present disclosure. The plurality of cascade holes 108 of the ferrule 90 fluidly communicate with the plurality of channels 100 of the ferrule 90. The plurality of cascade holes 108 are provided within sidewalls of each of the plurality of channels 100. As shown in FIG. 5, the plurality of cascade holes 108 define a plurality of passageways 109 that are transverse to the plurality of channels 100. The plurality of pins 110 (shown in FIG. 7) can be inserted through the plurality of cascade holes 108 and through the passageways 109.

Figure 6:
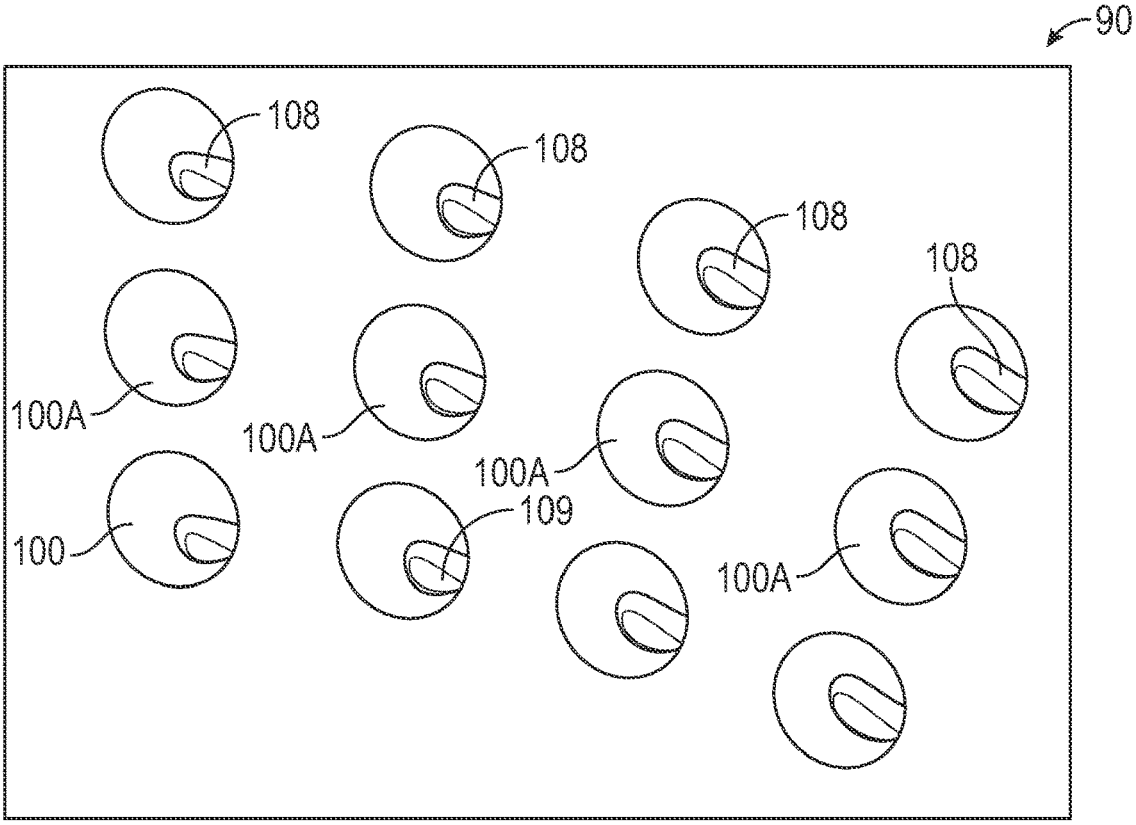
FIG. 6 is front view of a portion of the ferrule, according to an embodiment of the present disclosure.

FIG. 6 is front view of a portion of the ferrule 90, according to an embodiment of the present disclosure. FIG. 6 shows the exit openings 100A of the plurality of channels 100 and the cascade holes 108 that form the passageways 109. The plurality of channels 100 and the plurality of passageways 109 communicate with each other.

Figure 7:
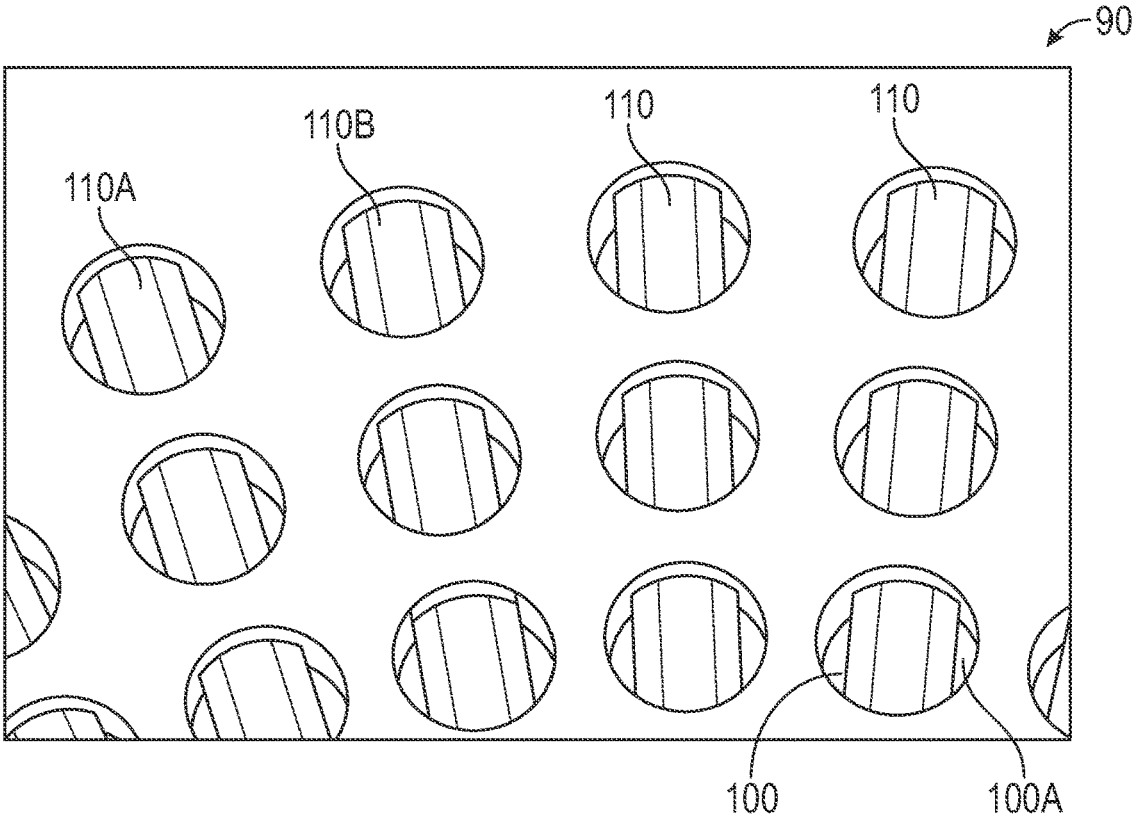
FIG. 7 is a front view of the ferrule showing exit openings of a plurality of channels in the ferrule, according to an embodiment of the present disclosure.

FIG. 7 is a front view of the ferrule 90 showing exit openings 100A of the plurality of channels 100 in the ferrule 90, according to an embodiment of the present disclosure. As shown in FIG. 7, the plurality of pins 110 are inserted through the cascade holes 108 into the passageways 109 (shown in FIGS. 5 and 6). Each of the plurality of pins 110 interferes with the airflow 104 through the plurality of channels 100 by reducing the velocity of the airflow 104. Velocity vortex pairs are created as the airflow 104 emerges out through the exit openings 100A after circumventing the pins 110. The generated low velocity vortex pairs do not create strong interaction of airflow 104 with the primary vane airflow 106. As a result, a level of flow instabilities within venturi is reduced. The fuel nozzle 92 in the ferrule 90 is configured to provide fuel for mixing with the airflow 104 and the primary vane airflow 106. In an embodiment, the fuel nozzle 92 in the ferrule 90 is configured to provide fuel for mixing with the velocity vortex pairs of the airflow 104 and the primary vane airflow 106. The term "venturi" is used herein to refer to the fluid path or the air path from purge holes 96 to the outlet 82, shown in FIG. 3.

In an embodiment, the plurality of cascade holes 108 (FIGS. 5 and 6) can be interconnected with each other within ferrule 90 with smaller tubular holes. By doing so, this helps to further reduce flow instabilities within the venturi. In addition, by providing a plurality of channels 100 with smaller cross-sectional diameters away from the exit openings 100A can reduce pressure fluctuation of the airflow 104. In addition, by providing smaller tubular holes connecting between the plurality of channels 100, equalizes pressure through the plurality of channels 100 at a different radial location and, hence, reduces flow fluctuation in the venturi. The plurality of cascade holes 108 can be circular holes, elliptical holes, annular holes, polygonal holes, etc.

Although the exit openings 100A of the plurality of channels 100 are shown in FIG. 6 to have a circular shape, the shape of the exit openings 100A of the plurality of channels 100 is not limited to a circular shape but can be any other shape, such as, but not limited to, elliptical, polygonal, or any other shape. Similarly, the plurality of channels 100 are not limited to a cylindrical shape with a circular base, but can have any other shape such a cylindrical shape with an elliptical or a polygonal base. In addition, the plurality of channels 100 may also not be a straight path shape and instead provided as serpentine or wave path shape.

The plurality of pins 110 can be arranged in a radial or a circumference configuration so that each pin traverses one or more channels in the plurality of channels 100, as shown in FIGS. 5, 6, and 7. For example, as shown in FIG. 7, each pin 110 traverses three channels 100. However, one or more pins in the plurality of pins 110 can be arranged to traverse one or more channels in the plurality of channels 100. For example, a first pin 110A when inserted through one passageway 109 (FIG. 6) may traverse three channels 100 while a second pin 110B when inserted through another passageway 109 can traverse two channels 100. The plurality of pins 110 can be provided with any desired shape. For example, the plurality of pins 110 can be rods with a base that is circular, elliptical, racetrack, or polygonal (triangular, square rectangular, pentagonal, hexagonal, etc.). The location of the pins can also be configured and positioned for better performance. The shape of the plurality of channels 100 can be straight or wavy. In addition, a cross section of the plurality of channels 100 can be circular, elliptical, wavy, or polygonal (triangular, square rectangular, pentagonal, hexagonal, etc.). Similarly, the plurality of passageways 109 can have a cross section that is circular, elliptical, or polygonal.

Figure 8:
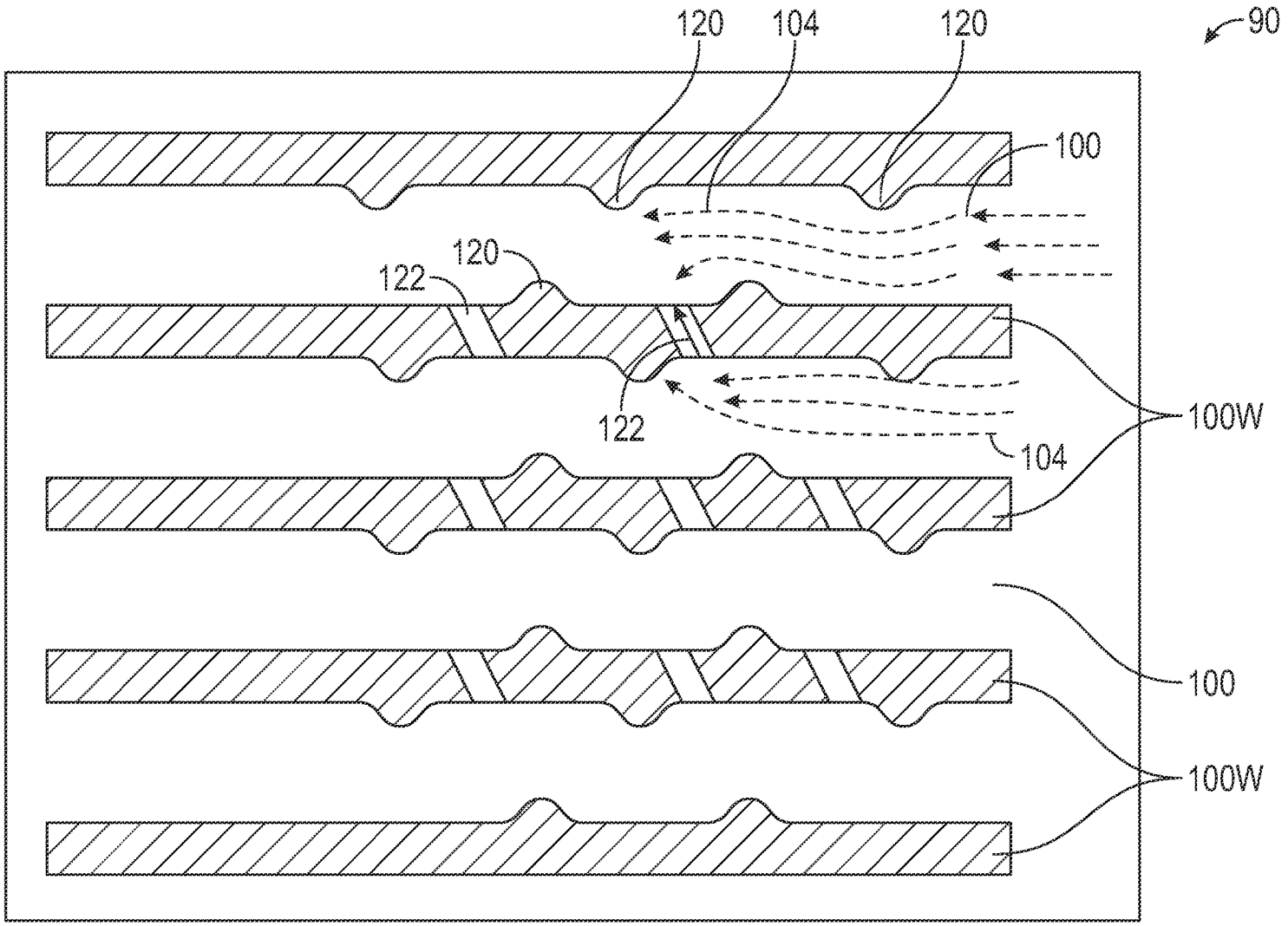
FIG. 8 is a schematic cross-sectional view of a portion of the ferrule, according to another embodiment of the present disclosure.

FIG. 8 is a schematic cross-sectional view of a portion of the ferrule 90, according to another embodiment of the present disclosure. In this embodiment, instead of or in addition to using the plurality of pins 110, to interfere with the airflow 104 in each of the plurality of channels 100, another plurality of airflow modifiers such as a plurality of protrusion 120 (e.g., bumps) can be provided in sidewalls 100W of the plurality of channels 100 to reduce the velocity of airflow 104 therein, as depicted schematically in FIG. 8. In addition, a plurality of see-through holes 122 can also be provided within sidewalls 100W of the plurality of channels 100. In an embodiment, a size of the plurality of protrusions 120 is smaller than a size of the plurality of channels 100 in the transverse direction. The plurality of protrusions 120 are thus distributed along the sidewall 100W of each of the plurality of channels 100.

As a result, the embodiments of the present disclosure described above allow for low combustor dynamics P'4. The above described configurations may be suitable for additive build, in any manufacturing method. With additive manufacturing, these configurations can be readily implemented to allow more flexibility in a combustor design. The above described configurations also allow to meet emission requirement while improving durability of the combustor system and engine as whole.

As can be appreciated from the discussion above, a ferrule is provided in a fuel-air mixer assembly. The ferrule includes a body comprising (i) a plurality of channels having sidewalls, the plurality of channels leading to a corresponding plurality of exit openings, the plurality of channels configured to guide a first airflow therein and (ii) a plurality of cascade holes formed within the sidewalls of the plurality of channels and defining a plurality of passageways therein that are transverse to the plurality of channels. The ferrule also includes a plurality of airflow modifiers provided within the plurality of channels. The plurality airflow modifiers are configured to reduce a velocity of the first airflow when the first airflow exits through the plurality of exit openings and to generate low velocity vortex pairs to reduce interaction of the first airflow with a second airflow provided through primary vanes located downstream of the plurality of exit openings of the plurality of channels.

In an embodiment and according to the preceding paragraph, the plurality of airflow modifiers include a plurality of pins inserted through the plurality of cascade holes into the plurality of passageways.

In an embodiment, according to any of the preceding paragraphs, each of the plurality of pins interfere with the first airflow within at least one of the plurality of channels to reduce the velocity of the first airflow therein.

In an embodiment, according to any of the preceding paragraphs, the plurality of channels are straight or wavy channels.

In an embodiment, according to any of the preceding paragraphs, a cross section of one or more of the plurality of channels is circular, elliptical, or polygonal.

In an embodiment, according to any of the preceding paragraphs, the plurality of exit openings have a circular shape, an elliptical shape, or a polygonal shape.

In an embodiment, according to any of the preceding paragraphs, the plurality of passageways have a cross section having an circular shape, an elliptical shape or a polygonal shape.

In an embodiment, according to any of the preceding paragraphs, the plurality of airflow modifiers comprise a plurality of protrusions provided on the sidewalls of the plurality of channels to reduce the velocity of the first airflow therein.

In an embodiment, according to any of the preceding paragraphs, a size of the plurality of protrusions is smaller than a size of the plurality of channels in a transverse direction of the plurality of channels.

In an embodiment, according to any of the preceding paragraphs, the ferrule further includes a fuel nozzle disposed axially within the body, the fuel nozzle configured to provide fuel for mixing with the first airflow and the second airflow According to another aspect of the present disclosure, a fuel-air mixer assembly is provided for use in a combustor. The fuel-air mixer assembly includes (A) a mixer portion, and (B) a ferrule coupled to the mixer portion, the ferrule including: (a) a body comprising (i) a plurality of channels having sidewalls, the plurality of channels leading to a corresponding plurality of exit openings, the plurality of channels configured to guide a first airflow therein and (ii) a plurality of cascade holes formed within the sidewalls of the plurality of channels and defining a plurality of passageways therein that are transverse to the plurality of channels; and (b) a plurality of airflow modifiers provided within the plurality of channels. The plurality airflow modifiers are configured to reduce a velocity of the first airflow when the first airflow exits through the plurality of exit openings and to generate low velocity vortex pairs to reduce interaction of the first airflow with a second airflow provided through primary vanes located downstream of the plurality of exit openings of the plurality of channels.

In an embodiment, according to the previous paragraph, the plurality of airflow modifiers comprise a plurality of pins inserted through the plurality of cascade holes into the plurality of passageways.

In an embodiment, according to any of the previous paragraphs, each of the plurality of pins interfere with the first airflow within at least one of the plurality of channels to reduce the velocity of the first airflow therein.

In an embodiment, according to any of the previous paragraphs, a cross section of one or more of the plurality of channels is circular, elliptical, or polygonal, or the plurality of exit openings have a circular shape, an elliptical shape or a polygonal shape.

In an embodiment, according to any of the previous paragraphs, the plurality of airflow modifiers include a plurality of protrusions provided on the sidewalls of the plurality of channels to reduce the velocity of the first airflow therein.

According to another aspect of the present disclosure, a turbine engine includes a combustor having a fuel nozzle assembly and a fuel-air mixer assembly coupled to the fuel nozzle assembly, the fuel-air mixer assembly including: (A) a mixer portion, and (B) a ferrule coupled to the mixer portion including: (a) a body comprising (i) a plurality of channels having sidewalls, the plurality of channels leading to a corresponding plurality of exit openings, the plurality of channels configured to guide a first airflow therein and (ii) a plurality of cascade holes formed within the sidewalls of the plurality of channels and defining a plurality of passageways therein that are transverse to the plurality of channels, and (b) a plurality of airflow modifiers provided within the plurality of channels. The plurality airflow modifiers are configured to reduce a velocity of the first airflow when the first airflow exits through the plurality of exit openings and to generate low velocity vortex pairs to reduce interaction of the first airflow with a second airflow provided through primary vanes located downstream of the plurality of exit openings of the plurality of channels.

In an embodiment, according to the previous paragraph, the plurality of airflow modifiers comprise a plurality of pins inserted through the plurality of cascade holes into the plurality of passageways.

In an embodiment, according to any of the previous paragraphs, each of the plurality of pins interfere with the first airflow within at least one of the plurality of channels to reduce the velocity of the first airflow therein.

In an embodiment, according to any of the previous paragraphs, a cross section of one or more of the plurality of channels is circular, elliptical, or polygonal, or the plurality of exit openings have a circular shape, an elliptical shape or a polygonal shape.

In an embodiment, according to any of the previous paragraphs, the plurality of airflow modifiers comprise a plurality of protrusions provided on the sidewalls of the plurality of channels to reduce the velocity of the first airflow therein.

Although the foregoing description is directed to the preferred embodiments of the present disclosure, it is noted that other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A ferrule in a fuel-air mixer assembly, the ferrule comprising:

a body comprising (i) a plurality of channels having sidewalls, the plurality of channels leading to a corresponding plurality of exit openings, the plurality of channels configured to guide a first airflow therein and (ii) a plurality of cascade holes formed within the sidewalls of the plurality of channels and defining a plurality of passageways therein that are transverse to the plurality of channels; and a plurality of airflow modifiers provided within the plurality of channels, wherein the plurality airflow modifiers are configured to reduce a velocity of the first airflow when the first airflow exits through the plurality of exit openings and to generate low velocity vortex pairs to reduce interaction of the first airflow with a second airflow provided through primary vanes located downstream of the plurality of exit openings of the plurality of channels.

2. The ferrule according to claim 1, wherein the plurality of channels are straight channels or wavy channels.

3. The ferrule according to claim 1, wherein a cross section of one or more of the plurality of channels is circular, elliptical, or polygonal.

4. The ferrule according to claim 1, wherein the plurality of exit openings have a circular shape, an elliptical shape, or a polygonal shape.

5. The ferrule according to claim 1, wherein the plurality of passageways have a cross section having a circular shape, an elliptical shape, or a polygonal shape.

6. The ferrule according to claim 1, further comprising a fuel nozzle disposed axially within the body, the fuel nozzle configured to provide fuel for mixing with the first airflow and the second airflow.

7. The ferrule according to claim 1, wherein the plurality of airflow modifiers comprise a plurality of pins inserted through the plurality of cascade holes into the plurality of passageways.

8. The ferrule according to claim 7, wherein each of the plurality of pins interfere with the first airflow within at least one of the plurality of channels to reduce the velocity of the first airflow therein.

9. The ferrule according to claim 1, wherein the plurality of airflow modifiers comprise a plurality of protrusions provided on the sidewalls of the plurality of channels to reduce the velocity of the first airflow therein.

10. The ferrule according to claim 9, wherein a size of the plurality of protrusions is smaller than a size of each of the plurality of channels in a transverse direction.

11. A fuel-air mixer assembly for use in a combustor, the fuel-air mixer assembly comprising:

(A) a mixer portion; and (B) a ferrule coupled to the mixer portion, the ferrule comprising:

(a) a body comprising (i) a plurality of channels having sidewalls, the plurality of channels leading to a corresponding plurality of exit openings, the plurality of channels configured to guide a first airflow therein and (ii) a plurality of cascade holes formed within the sidewalls of the plurality of channels and defining a plurality of passageways therein that are transverse to the plurality of channels; and (b) a plurality of airflow modifiers provided within the plurality of channels, wherein the plurality airflow modifiers are configured to reduce a velocity of the first airflow when the first airflow exits through the plurality of exit openings and to generate low velocity vortex pairs to reduce interaction of the first airflow with a second airflow provided through primary vanes located downstream of the plurality of exit openings of the plurality of channels.

12. The fuel-air mixer assembly according to claim 11, wherein a cross section of one or more of the plurality of channels is circular, elliptical, or polygonal.

13. The fuel-air mixer assembly according to claim 11, wherein the plurality of airflow modifiers comprise a plurality of protrusions provided on the sidewalls of the plurality of channels to reduce the velocity of the first airflow therein.

14. The fuel-air mixer assembly according to claim 11, wherein the plurality of airflow modifiers comprise a plurality of pins inserted through the plurality of cascade holes into the plurality of passageways.

15. The fuel-air mixer assembly according to claim 14, wherein each of the plurality of pins interfere with the first airflow within at least one of the plurality of channels to reduce the velocity of the first airflow therein.

16. A turbine engine comprising:

a combustor comprising a fuel nozzle assembly and a fuel-air mixer assembly coupled to the fuel nozzle assembly, the fuel-air mixer assembly comprising:

(A) a mixer portion; and (B) a ferrule coupled to the mixer portion comprising:

(a) a body comprising (i) a plurality of channels having sidewalls, the plurality of channels leading to a corresponding plurality of exit openings, the plurality of channels configured to guide a first airflow therein and (ii) a plurality of cascade holes formed within the sidewalls of the plurality of channels and defining a plurality of passageways therein that are transverse to the plurality of channels; and (b) a plurality of airflow modifiers provided within the plurality of channels, wherein the plurality airflow modifiers are configured to reduce a velocity of the first airflow when the first airflow exits through the plurality of exit openings and to generate low velocity vortex pairs to reduce interaction of the first airflow with a second airflow provided through primary vanes located downstream of the plurality of exit openings of the plurality of channels.

17. The turbine engine according to claim 16, wherein a cross section of one or more of the plurality of channels is circular, elliptical, or polygonal.

18. The turbine engine according to claim 16, wherein the plurality of airflow modifiers comprise a plurality of protrusions provided on the sidewalls of the plurality of channels to reduce the velocity of the first airflow therein.

19. The turbine engine according to claim 16, wherein the plurality of airflow modifiers comprise a plurality of pins inserted through the plurality of cascade holes into the plurality of passageways.

20. The turbine engine according to claim 19, wherein each of the plurality of pins interfere with the first airflow within at least one of the plurality of channels to reduce the velocity of the first airflow therein.

* * * * *